US012710247B2

(12) United States Patent
Palmer et al.

(10) Patent No.: US 12,710,247 B2
(45) Date of Patent: Aug. 18, 2026

(54) FIREARM GRIP

(71) Applicant: Caracal International, LLC, Sweihan (AE)

(72) Inventors: Andrew Palmer, Arabian Ranches (AE); Konstantin Nedev, Al Zeina (AE); Naser Ali Alomaira, Abu Dhabi (AE)

(73) Assignee: CARACAL INTERNATIONAL, LLC, Sweihan (AE)

( * ) Notice: Subject to any disclaimer, the term of this patent is extended or adjusted under 35 U.S.C. 154(b) by 0 days.

(21) Appl. No.: 18/882,651

(22) Filed: Sep. 11, 2024

(65) Prior Publication Data

US 2025/0085079 A1 Mar. 13, 2025

Related U.S. Application Data

(60) Provisional application No. 63/538,154, filed on Sep. 13, 2023.

(51) Int. Cl.
*F41C 23/16* (2006.01)

(52) U.S. Cl.
CPC ..... *F41C 23/16* (2013.01)

(58) Field of Classification Search
CPC ..... F41C 23/16
See application file for complete search history.

(56) References Cited

U.S. PATENT DOCUMENTS 4,333,256 A * 6/1982 Hogue ..... F41C 23/10 42/71.02
4,342,170 A * 8/1982 Hogue ..... F41C 23/10 42/71.02
4,502,238 A * 3/1985 Farrar ..... F41C 7/02 42/72
4,520,585 A * 6/1985 Barrett ..... F41C 23/10 42/7
4,570,370 A * 2/1986 Smith ..... F41C 23/10 42/71.02
5,274,940 A * 1/1994 Guzy ..... F16M 11/08 89/37.04
6,487,807 B1 * 12/2002 Kopman ..... F41A 23/12 42/72
6,928,764 B2 * 8/2005 Freed ..... F41A 9/65 42/71.02

(Continued)

*Primary Examiner* — Michelle Clement
(74) *Attorney, Agent, or Firm* — Bennet K. Langlotz; Langlotz Patent & Trademark Works, LLC

(57) ABSTRACT

A firearm grip has an elongated body having an upper end having an upper attachment facility configured to attach to a firearm, the elongated body having an opposed lower end having a second attachment facility, a palm rest element having a base element having a third attachment facility configured to removably connect to the second attachment facility, the palm rest having a palm support element connected to the base element, and the palm support element defining a central aperture receiving the base element and having an upper surface encompassing the base element. The palm support element may be pivotally connected to the base element. The palm support element may be connected to pivot about a pivot axis transverse to a major plane of the firearm. The pivot axis may be at a level below the opposed lower end of the elongated body.

15 Claims, 6 Drawing Sheets

(56) References Cited

U.S. PATENT DOCUMENTS 6,981,344 B2 * 1/2006 Cahill ..... F41C 23/10 D22/104
7,191,557 B2 * 3/2007 Gablowski ..... F41C 23/16 42/72
7,665,241 B2 * 2/2010 Oz ..... F41A 23/08 89/37.04
7,712,241 B2 * 5/2010 Teetzel ..... F41A 23/08 42/72
7,743,542 B1 * 6/2010 Novak ..... F41A 9/24 42/49.02
7,748,153 B2 * 7/2010 Beretta ..... F41C 23/10 42/71.02
7,823,312 B2 * 11/2010 Faifer ..... F41A 35/00 42/71.01
7,823,855 B2 * 11/2010 Faifer ..... F16M 11/26 248/188.5
7,954,271 B1 * 6/2011 Bentley ..... F41C 23/16 42/72
8,056,277 B2 * 11/2011 Griffin ..... F41C 27/00 42/72
8,151,504 B1 * 4/2012 Aiston ..... F41C 23/10 42/71.01
8,215,047 B2 * 7/2012 Ash, Jr. ..... F41C 23/14 42/71.01
8,341,864 B2 * 1/2013 Moody ..... G03B 17/561 42/72
8,561,338 B2 * 10/2013 Chvala ..... F41C 23/08 42/74
8,601,734 B1 * 12/2013 Hopkins ..... F41C 23/14 42/71.01
8,607,491 B2 * 12/2013 Moody ..... F41A 23/08 42/72
8,839,544 B2 * 9/2014 Troy ..... F41C 23/16 42/72
8,857,093 B2 * 10/2014 Hogue ..... F41C 23/10 42/74
8,857,094 B2 * 10/2014 Michel ..... F41C 23/10 42/71.01
9,010,008 B2 * 4/2015 Hovey ..... F41C 23/16 42/72
9,383,162 B2 * 7/2016 Spykerman ..... F41C 23/14
9,389,044 B2 * 7/2016 Rice ..... F41C 27/16
9,573,268 B2 * 2/2017 Azhocar ..... F16M 11/14
9,709,356 B1 * 7/2017 Anstett ..... F41C 23/16
9,718,182 B2 * 8/2017 Azhocar ..... B25G 3/36
10,018,446 B2 * 7/2018 Derousse ..... F41C 23/16
10,041,761 B2 * 8/2018 Sitzman ..... F42B 39/02
10,101,110 B2 * 10/2018 Faifer ..... F41A 23/10
10,180,301 B2 * 1/2019 Hogue ..... F41C 23/10
10,337,813 B2 * 7/2019 Jonsson ..... F41A 3/66
10,502,365 B2 * 12/2019 Moody ..... G03B 17/563
10,527,387 B1 * 1/2020 Oliva Chavez ..... F41C 23/16
10,724,824 B1 * 7/2020 Lister ..... F41C 23/12
10,859,343 B1 * 12/2020 Glen ..... F41C 23/10
10,866,061 B2 * 12/2020 Anstett ..... F41C 23/16
10,866,062 B1 * 12/2020 Derousse ..... F41C 27/00
10,883,794 B2 * 1/2021 Jen ..... F41C 33/007
10,921,076 B1 * 2/2021 Thomas ..... F41A 9/82
10,942,004 B2 * 3/2021 Grenier ..... F41C 23/14
10,955,204 B2 * 3/2021 Harrigan ..... F41A 5/02
11,054,222 B2 * 7/2021 Duffner ..... F41C 23/16
11,073,351 B2 * 7/2021 Tai ..... F41A 9/61
11,079,189 B2 * 8/2021 Hsu ..... F41A 3/66
11,112,208 B1 * 9/2021 Mantas ..... F41C 23/16
11,118,861 B2 * 9/2021 Holmes ..... F41C 23/14
11,162,758 B1 * 11/2021 Lee ..... F41C 23/10
11,385,020 B2 * 7/2022 Grenier ..... F41C 23/16
11,454,469 B2 * 9/2022 Nilson ..... F41A 11/02
11,466,954 B2 * 10/2022 Hughes ..... F41C 23/10
11,499,797 B2 * 11/2022 Mantas ..... F41C 23/16
11,578,935 B2 * 2/2023 Hsu ..... F41A 3/66
11,906,264 B2 * 2/2024 Tasyagan ..... F41C 23/14
11,988,484 B2 * 5/2024 Keller ..... F41C 23/10
12,013,207 B2 * 6/2024 Leon-Guerrero ..... H01H 21/22
12,031,793 B1 * 7/2024 Crye ..... F41C 23/04
12,078,439 B2 * 9/2024 Curry ..... F41A 19/44
12,098,898 B2 * 9/2024 Noonan ..... F41C 23/10
12,298,100 B2 * 5/2025 Roberson ..... F41G 11/003
12,320,606 B2 * 6/2025 Strechinski ..... F41C 23/10
12,339,094 B2 * 6/2025 Underwood ..... F41C 23/16
2008/0052979 A1 * 3/2008 Lee ..... F41C 23/16 42/73
2009/0193702 A1 * 8/2009 Lin ..... F41C 23/16 42/72
2009/0313873 A1 * 12/2009 Roth ..... F41C 23/16 42/72
2010/0139144 A1 * 6/2010 Fitzpatrick ..... F41C 23/16 42/73
2010/0281741 A1 * 11/2010 Gibson ..... F41C 23/10 42/71.02
2016/0245616 A1 * 8/2016 Derousse ..... F41C 23/16
2016/0332290 A1 * 11/2016 Azhocar ..... F16M 11/14
2016/0341517 A1 * 11/2016 Williams ..... B33Y 50/00
2020/0378718 A1 * 12/2020 Sun ..... F41C 23/10
2021/0108885 A1 * 4/2021 Derousse ..... F41C 23/16
2021/0172702 A1 * 6/2021 Harrigan ..... F41C 3/00
2022/0307795 A1 * 9/2022 Tasyagan ..... F41C 23/16
2022/0364823 A1 * 11/2022 Tanaka ..... F41C 23/16
2025/0067529 A1 * 2/2025 Hsu ..... F41A 11/02
2025/0085079 A1 * 3/2025 Palmer ..... F41C 23/16
2025/0146786 A1 * 5/2025 Seelye ..... F41C 23/16
2025/0164209 A1 * 5/2025 Hedeen ..... F41G 1/35

* cited by examiner

FIREARM GRIP

CROSS-REFERENCE TO RELATED APPLICATION

This application claims the benefit of U.S. Provisional Patent Application No. 63/538,154 filed on Sep. 13, 2023, entitled "MODULAR GRIP," which is hereby incorporated by reference in its entirety for all that is taught and disclosed therein.

FIELD OF THE INVENTION

The present invention relates to firearms, and more particularly to a firearm grip that enables the grip to be easily and quickly adjusted from a carbine grip to a sniper grip and to accommodate a variety of user hand sizes.

BACKGROUND AND SUMMARY OF THE INVENTION

Firearm grips provide many advantages to the user when they are installed on a firearm, such as a rifle or machine gun. A firearm grip stabilizes the firearm, which helps maintain sight alignment and reduces muzzle flip from recoil. This allows for faster shooting and more accurate shots. For the user's comfort and maximum firearm accuracy, it is desirable for the firearm grip to not be too large or small for the user's hand. Furthermore, depending on how the firearm is to be used, different style grips are preferred. For example, a sniper may prefer the addition of a palm rest that is not needed by a carbine user.

Therefore, a need exists for a new and improved firearm grip that enables the grip to be easily and quickly adjusted from a carbine grip to a sniper grip and to accommodate a variety of user hand sizes. In this regard, the various embodiments of the present invention substantially fulfill at least some of these needs. In this respect, the firearm grip according to the present invention substantially departs from the conventional concepts and designs of the prior art, and in doing so provides an apparatus primarily developed for the purpose of enabling the grip to be easily and quickly adjusted from a carbine grip to a sniper grip and to accommodate a variety of user hand sizes.

The present invention provides an improved firearm grip, and overcomes the above-mentioned disadvantages and drawbacks of the prior art. As such, the general purpose of the present invention, which will be described subsequently in greater detail, is to provide an improved firearm grip that has all the advantages of the prior art mentioned above.

To attain this, the preferred embodiment of the present invention essentially comprises an elongated body having an upper end having an upper attachment facility configured to attach to a firearm, the elongated body having an opposed lower end having a second attachment facility, a palm rest element having a base element having a third attachment facility configured to removably connect to the second attachment facility, the palm rest having a palm support element connected to the base element, and the palm support element defining a central aperture receiving the base element and having an upper surface encompassing the base element. The palm support element may be pivotally connected to the base element. The palm support element may be connected to pivot about a pivot axis transverse to a major plane of the firearm. The pivot axis may be at a level below the opposed lower end of the elongated body. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
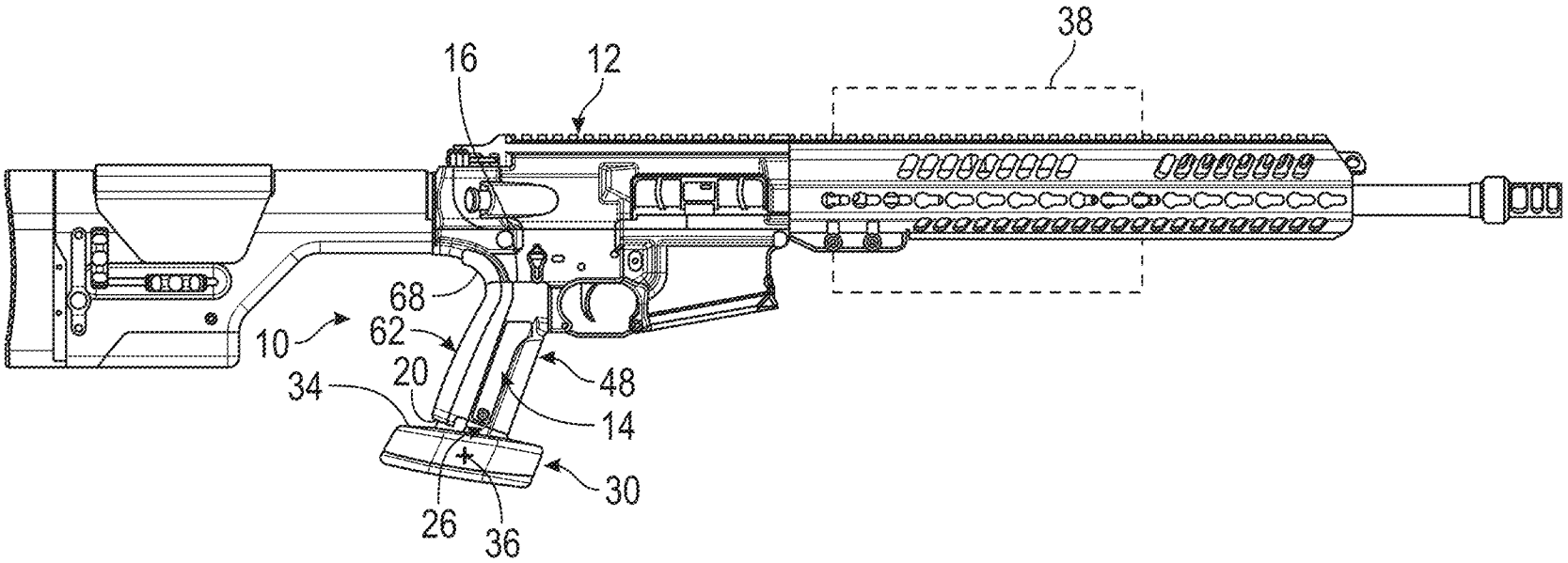
FIG. 1 is a right side view of the current embodiment of a firearm grip constructed in accordance with the principles of the present invention in use attached to a rifle.
Figure 2:
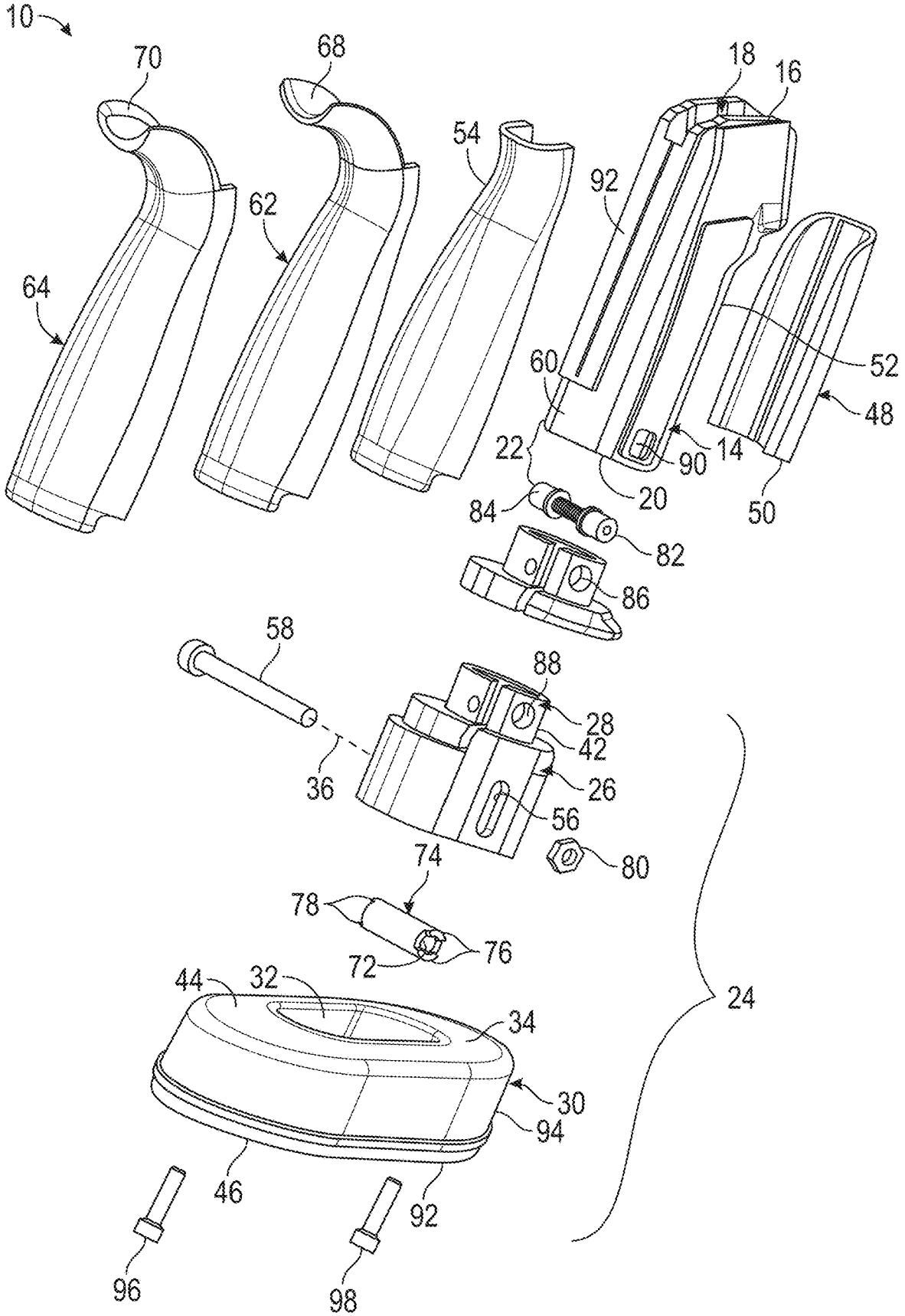
FIG. 2 is an exploded view of the firearm grip of FIG. 1 detached from the rifle.

An embodiment of the firearm grip of the present invention is shown and generally designated by the reference numeral 10.

FIGS. 1-6 illustrate the improved firearm grip 10 of the present invention. More particularly, FIG. 1 shows the firearm grip in use connected to a firearm 12, which is a rifle in the current embodiment. The firearm grip includes an elongated body 14 having an upper end 16 having an upper attachment facility 18 configured to attach to the firearm. The elongated body has an opposed lower end 20 having a second attachment facility 22. A palm rest element 24 has a base element 26 having a third attachment facility 28 configured to removably connect to the second attachment facility. The palm rest element has a palm support element 30 connected to the base element. The palm support element defines a central aperture 32 receiving the base element and having an upper surface 34 encompassing the base element.

In the current embodiment, the palm support element 30 is pivotally connected to the base element 26. The palm support element is connected to pivot about a pivot axis 36 transverse to a major plane 38 of the firearm 12. The pivot axis is at a level below the opposed lower end 20 of the elongated body 14. The second attachment facility 22 of the elongated body defines a grip aperture 40, and the third attachment facility 28 includes a protrusion 42 configured to be received in the grip aperture. The palm support element is at a level below the opposed lower end of the elongated body. The palm support element has an upper surface 44 at a level below the opposed lower end of the elongated body. The palm support element has a lower surface 46 at a level below the opposed lower end of the elongated body. The palm support element has a bottom portion 92 connected to an upper portion 94 by two screws 96, 98 in the current embodiment. However, the bottom portion is optional and can either be removed or could be affixed to the upper portion by clips or a single screw and a locating tab.

A detachable elongated strap element 48 is configured for attachment along the length of the elongated body 14. The detachable elongated strap element has a lower end 50 above at least a portion of the palm support element 30. The detachable elongated strap element is a front strap configured for attachment along a front surface 52 of the elongated body. The detachable elongated strap element can also be a selected rear strap 54, 62, 64 configured for attachment along a rear surface 60 of the elongated body. The different rear straps provide the user with different options, such as beaver tails 68, 70 for the selected application and user comfort. When serving as a front strap, the detachable elongated strap element can be manufactured in a variety of sizes and textures to accommodate user preferences.

Figure 3A:
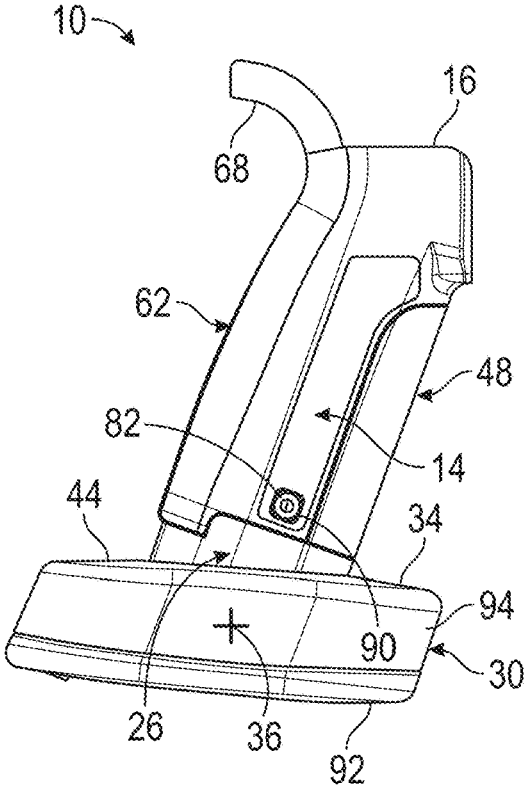
FIG. 3A is a right side view of the firearm grip of FIG. 1 detached from the rifle with the palm rest element adjusted to a maximum of travel in a selected direction.
Figure 3B:
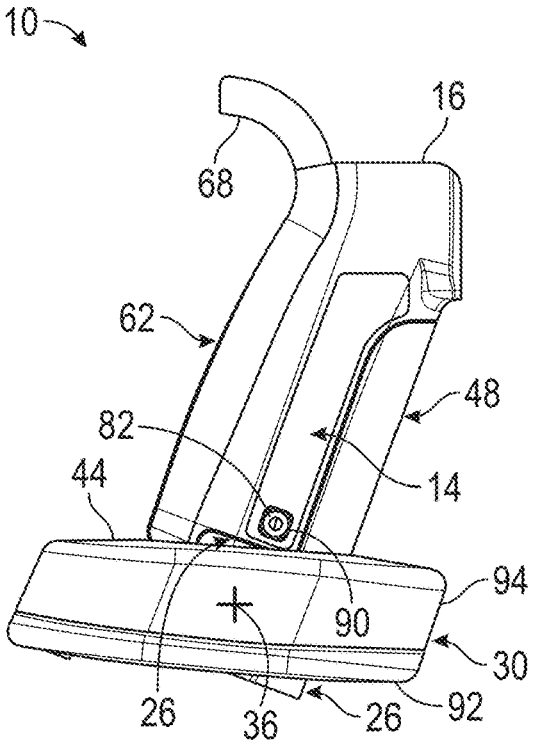
FIG. 3B is a right side view of the firearm grip of FIG. 1 detached from the firearm with the palm rest element adjusted to a maximum of travel in a selected opposite direction.

The palm support element 24 is connected to the base element 26 over a range of different vertical positions. The base element defines a vertical slot 56 defining the range of different vertical positions. A pivot element 58 is connected to the palm support element and received in the vertical slot. The pivot element is a bolt in the current embodiment that is received within a bore 72 defined by an anti-compression sleeve 74. The anti-compression sleeve has protrusions 76, 78 on either end that are received within the vertical slot. The anti-compression sleeve prevents collapse of the base element 26 when the pivot element is tightened. A captured nut 80 enables the pivot element to be tightened to secure the palm support element 30 at a selected height on the base element and at a selected angle relative to the base element. FIGS. 3A & B show the extremes of travel enabled by the pivot element.

For use as a carbine grip, a base element 66 that omits a palm rest element 24 can be connected to the second attachment facility 22 of the elongated body 14. Both the base element 66 and the base element 26 are releasably secured within the grip aperture 40 by spring-loaded pins 82, 84 that are received within apertures 86 defined by the base element 66 or apertures 88 defined by the base element 26. The spring-loaded pins are also received within apertures 90 defined by the elongated body 14.

Figure 4:
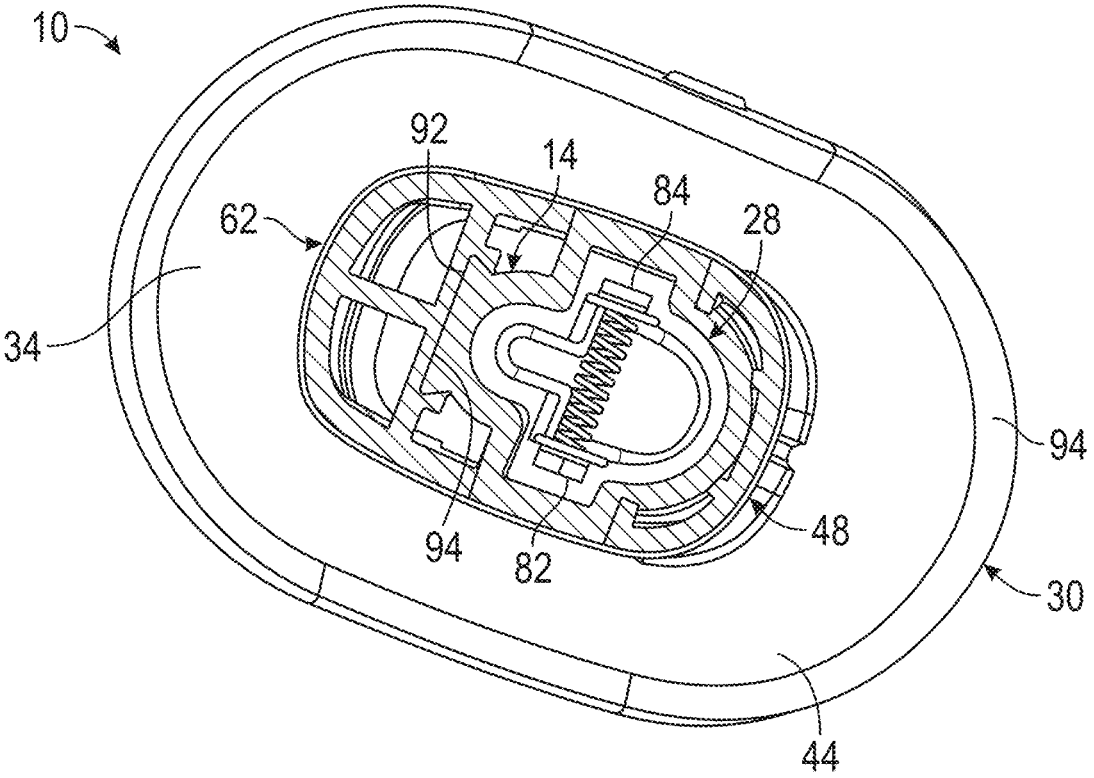
FIG. 4 is a cross-section view of the firearm grip of FIG. 1 detached from the rifle.
Figure 5:
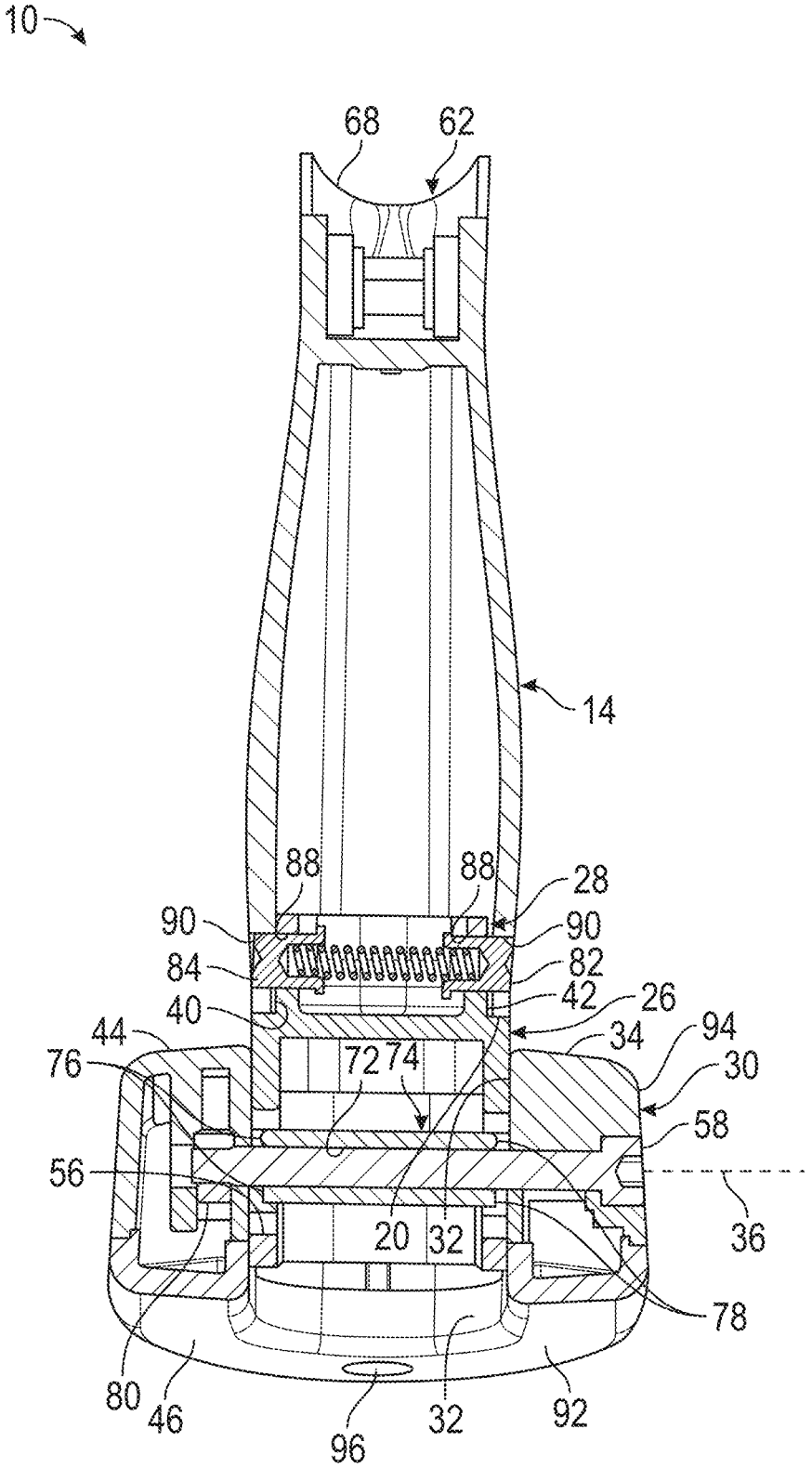
FIG. 5 is a front sectional view of the firearm grip of FIG. 1 detached from the rifle.
Figure 6:
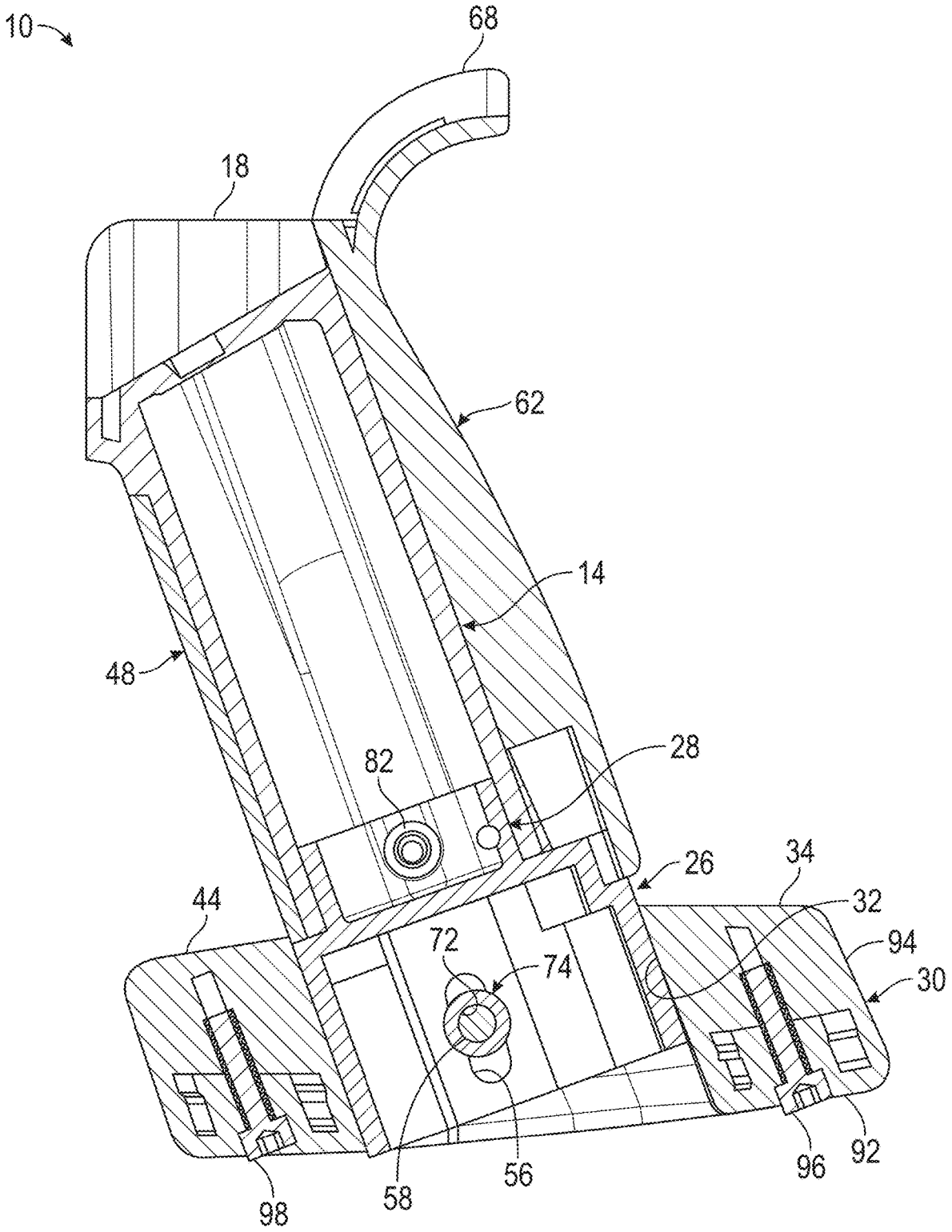
FIG. 6 is a side sectional view of the firearm grip of FIG. 1 detached from the rifle.

It should be appreciated that the elongated body 14 includes a dovetail protrusion 92 that is received within a dovetail slot 94 defined by the rear strap 54, 62, 64 (shown in FIG. 4).

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a firearm grip has been described in detail, it should be apparent that modifications and variations thereto are possible, all of which fall within the true spirit and scope of the invention. Although rifles have been disclosed, the firearm grip is also suitable for use with shotguns, light and medium machine guns, and other firearms. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A firearm grip comprising: an elongated body having an upper end having an upper attachment facility configured to attach to a firearm; the elongated body defining a longitudinal axis and a first outside diameter; the elongated body having an opposed lower end having a second attachment facility; the elongated body having a first length along the longitudinal axis; a palm rest element having a base element having a third attachment facility configured to removably connect to the second attachment facility; the palm rest element having a palm support element connected to the base element; the palm rest element having a second length along the longitudinal axis less than the first length; and the palm support element defining a central aperture receiving the base element and a second outside diameter wherein the second outside diameter is greater than the first outside diameter and having an upper surface encompassing the base element.

2. The firearm grip of claim 1 wherein the palm support element is pivotally connected to the base element.

3. The firearm grip of claim 2 wherein the palm support element is connected to pivot about a pivot axis transverse to a major plane of the firearm.

4. The firearm grip of claim 3 wherein the pivot axis is at a level below the opposed lower end of the elongated body.

5. The firearm grip of claim 1 wherein the second attachment facility of the elongated body defines a grip aperture, and the third attachment facility includes a protrusion configured to be received in the grip aperture.

6. The firearm grip of claim 1 wherein the palm support element is at a level below the opposed lower end of the elongated body.

7. The firearm grip of claim 1 wherein the palm support element has an upper surface at a level below the opposed lower end of the elongated body.

8. The firearm grip of claim 1 wherein the palm support element has a lower surface at a level below the opposed lower end of the elongated body.

9. The firearm grip of claim 1 including a detachable elongated strap element configured for attachment along the length of the elongated body.

10. The firearm grip of claim 9 wherein the detachable elongated strap element has a lower end above at least a portion of the palm support element.

11. The firearm grip of claim 9 wherein the detachable elongated strap element is a front strap configured for attachment along a front surface of the elongated body.

12. The firearm grip of claim 9 wherein the detachable elongated strap element is a rear strap configured for attachment along a rear surface of the elongated body.

13. The firearm grip of claim 1 wherein the palm support element is connected to the base element over a range of different vertical positions.

14. The firearm grip of claim 13 wherein the base element defines a vertical slot defining the range of different vertical positions.

15. The firearm grip of claim 14 including a pivot element connected to the palm support element and received in the vertical slot.

* * * * *